United States Patent [19]

D'Alessio et al.

[11] Patent Number: 4,516,663

[45] Date of Patent: May 14, 1985

[54] SAFETY DEVICE

[75] Inventors: Michael D'Alessio, Flushing; Charles Matcovich, Pearl River, both of N.Y.

[73] Assignee: Harsco Corporation, Camp Hill, Pa.

[21] Appl. No.: 358,311

[22] Filed: Mar. 15, 1982

[51] Int. Cl.[3] ..... B66B 11/04

[52] U.S. Cl. ..... 187/19; 74/422

[58] Field of Search ..... 187/19, 8.69, 1 R; 254/95, 112, 115; 74/412 TA, 412 R, 422, DIG. 10, 349, 461

[56] References Cited

U.S. PATENT DOCUMENTS

| | | | |
|---|---|---|---|
| 293,065 | 2/1884 | Palmer | 74/422 |
| 674,447 | 5/1901 | Mase | 74/422 |
| 2,548,603 | 4/1951 | Hallstrand | 74/422 |
| 3,924,710 | 12/1975 | Shobet | 187/19 |
| 3,926,067 | 12/1975 | Blanchard et al. | 74/461 |
| 4,318,304 | 3/1982 | Lang | 74/412 TA |

*Primary Examiner*—Joseph J. Rolla
*Assistant Examiner*—Kenneth Noland
*Attorney, Agent, or Firm*—Curtis, Morris & Safford

[57] ABSTRACT

A drive pinion disengaging device for use in rack and pinion hoists includes an outer section of rack having toothed portions above and below, an at least potentially toothless portion, and a bridging rack section adapted to be removed at the toothless portion by the drive pinion when under a predetermined load to permit the latter to disengage the rack in case of malfunction. This permits the large rotational inertia to be dissipated without injury to the drive mechanism. The point of disengagement is such as to occur preferably only when the hoist is engaged by the safety landing buffers (since the drive pinion is normally the only effective support for the hoist). The bridging rack section may be in the form of a narrow sliding rack maintained in a longitudinal slot in the main rack (extending along the entire toothless portion and slightly up into the toothed portion above) and normally secured in place across such actually toothless portion by a shear pin, detent, and the like; or may be a rack having shearable teeth (preferrably thinner than the main rack, or optionally of a softer material).

19 Claims, 15 Drawing Figures

FIG. 3
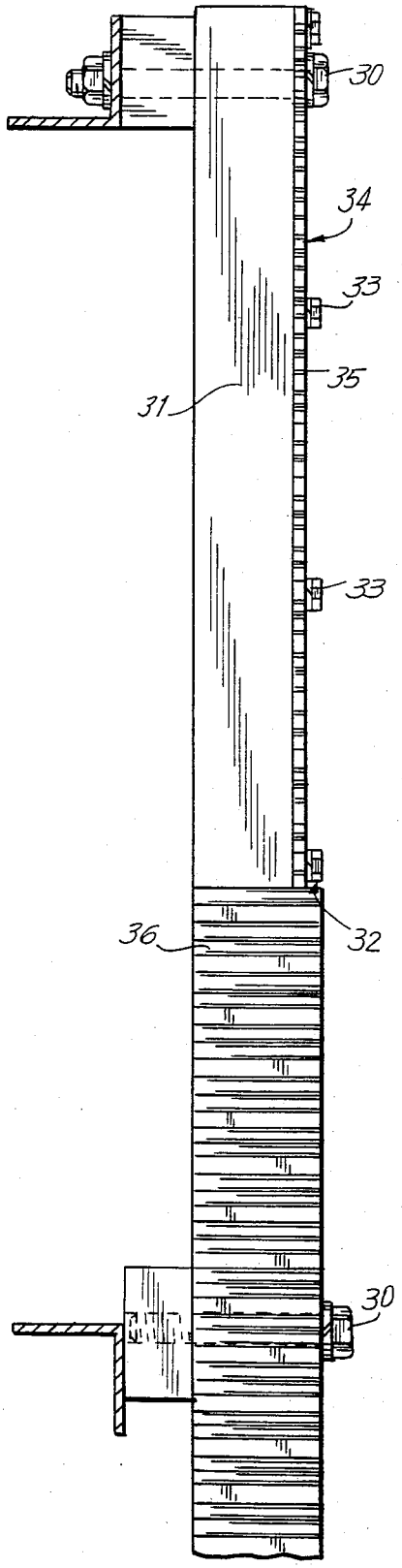
FIG. 4
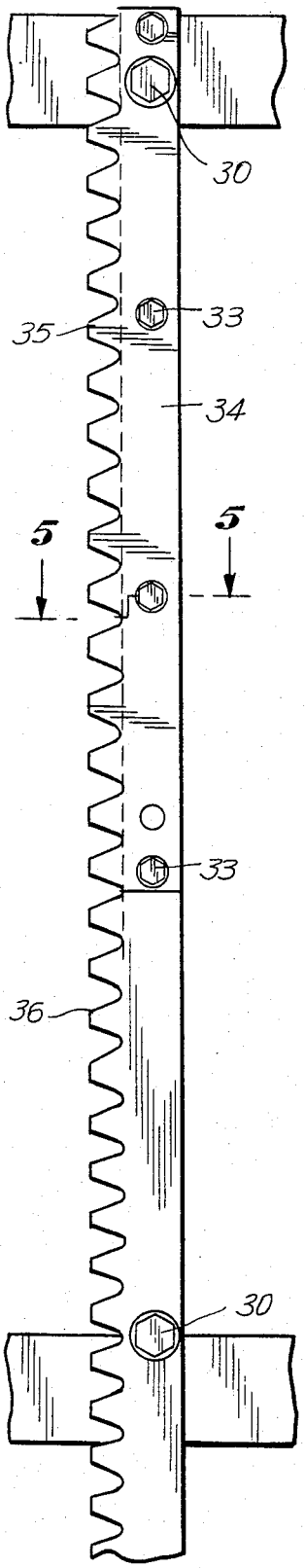
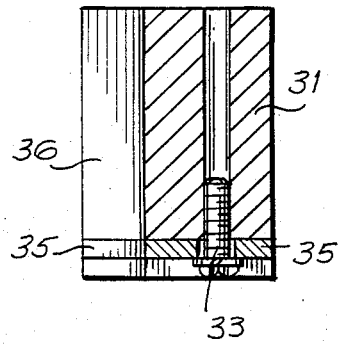
FIG. 5

FIG. 7
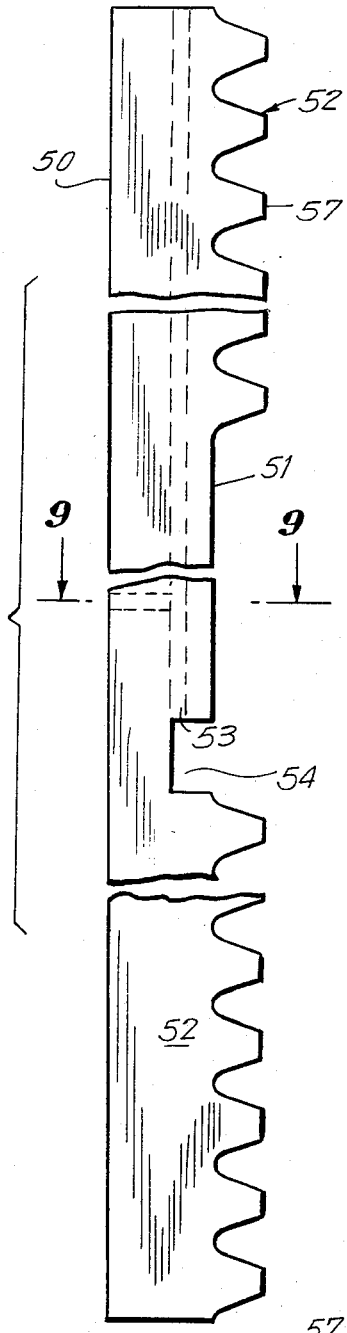
FIG. 8
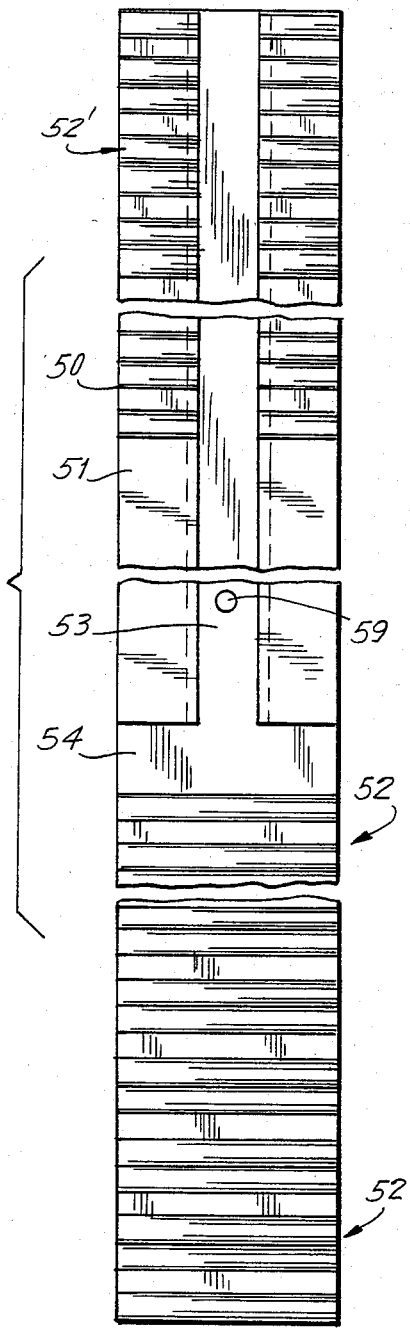
FIG. 10
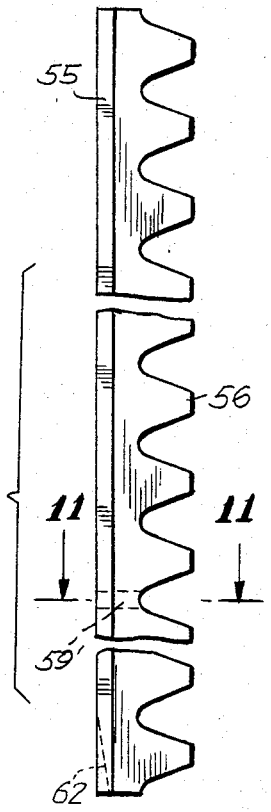
FIG. 15
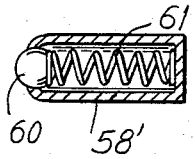
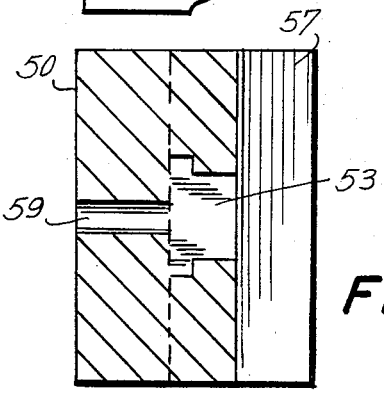
FIG. 9
FIG. 11
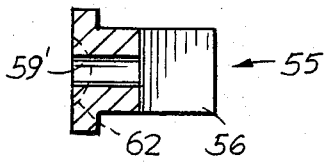

SAFETY DEVICE

The present invention relates to an improvement in personnel hoists of the rack and pinion type primarily used during the construction of multi-story buildings.

Rack and pinion hoists for the portage of workers and construction material are commonly known and used in the construction trade. The elevator portion basically comprises a platform, or cage if personnel are to be transported, a drive pinion, a safety or governor pinion, braking mechanisms and a drive mechanism including a motor to drive the drive pinion. The elevator portion rides on a toothed rack affixed to a temporary frame or tower that is disassembled upon completion of the building under construction. The drive pinion engages the rack and forces the elevator portion vertically upward. Normally buffer springs are affixed to a base which supports the tower and are positioned below the cage to protect the personnel carried therein in the event of an uncontrolled descent. More particularly, these springs are intended to reduce the impact on the cage should it uncontrollably reach its limit of travel before one of the two braking mechanisms usually provided can bring it to a stop.

The rack and pinion hoist may comprise other components, such as guide rollers, a gear reducer and a cathead and may or may not be of the counterweight type; all of the aforementioned components are known to one skilled in the art and do not concern the particular invention disclosed herein.

When rack and pinion hoists are used to transport personnel, they must be constructed in compliance with the guidelines set forth by the American National Standard Institute (ANSI). In the event of an uncontrolled descent, the normally unused buffer springs must be designed to limit the impact force on the cage to one gravity (1g), an acceleration of low enough magnitude to minimize injury to personnel riding in the cage. This is particularly a problem if the drive motor fails to shut off and continues to drive the cage beyond the bottom landing into the springs. While the minimum requirement of a 1g impact force is sufficient to protect the personnel riding in the cage, it is not nearly low enough to prevent damage to the drive mechanism when latter cannot be shut off or when other circumstances cause the cage to run into the buffer springs near or above the normal operating speed. This is because the gearing and physical masses making up the drive mechanism is such that the energy derived from the motor and brake rotation is four times that due to the linear motion of the cage. As a result, when a rack and pinion cage strikes the buffer springs even at its rated speed, the gear box is irreparably damaged.

One solution to the above-mentioned problem is to provide a buffer spring that will slow the descent of the cage to an acceleration which will leave the drive mechanism undamaged and which will, accordingly, provide an impact force on the cage which is much less than the 1g force required by the ANSI. However, this solution is impracticable. Calculations show that the stroke required to protect the gear box is approximately four feet. It is characteristic of spring buffers that they have a fully compressed height at least equal to their stroke, so that the minimum height required of such a buffer assembly capable of protecting the drive mechanism is eight feet. In view of the fact that the rack and pinion hoist is for temporary use only, it is unlikely that the user is willing or able to provide a pit deep enough to accommodate an eight foot high buffer assembly. Furthermore, the maximum practical height of a cage above ground level is 42 inches which corresponds to the height of a truck bed; all buffer assemblies should be limited to a height within this range.

Other solutions to the above-mentioned problem include incorporating a shear pin within the drive mechanism which will snap when a predetermined force is exerted upon the mechanism, or using friction or clutch gearing in the drive mechanism. For safety reasons, the ANSI has specifically prohibited such devices from being incorporated into the drive mechanism, so that up to now, no practical solution exists which will protect the drive mechanism.

It will be appreciated that this latter safety requirement derives from the fact that typically, apart from a counterweight, all of the weight of the hoist cage and its load are carried by the drive pinion. Thus it must at all times be in continuous engagement with the rack (except possibly when at the very bottom of the hoist). The safety pinion is typically attached to an over speed governor that trips an automatic brake if the speed of descent exceeds 340 feet per minute. Thus it also must always be in contact with the rack. This prevents the typical inherent free fall speed of 500'/min., but still leaves a considerable rotational and linear energy to be absorbed by the buffer springs even at lower descent rates.

Accordingly, it is an object of this invention to provide a device that can be used with a rack and pinion type hoist which will protect both the drive mechanism and the personnel carried in the cage in the event of an uncontrollable descent.

It is a further object of this invention to provide a device that will comply with the regulations promulgated by the ANSI.

It is a still further object of this invention to provide a device that requires minor modification to existing rack and pinion hoist systems and which obviates all of the previously described disadvantages inherent with known or previously contemplated solutions.

Several embodiments and variations thereof will be described herein, each of which concerns itself with disengaging the drive pinion when the cage descends to a predetermined distance from the buffer springs, more particularly, when the bottom of the cage first touches the buffer springs. A simple, though not necessarily obvious, solution would be to cut the teeth off the rack at this point, allowing the drive pinion to rotate freely. This solution is not possible in most cases, because the rack and pinion hoist is usually required to have a safety pinion rotatably mounted slightly below the drive pinion. As previously indicated, this safety pinion must be kept in mesh at all times with the toothed rack in order to be able to sense a "run away" situation and automatically brake an abnormally fast descent. The usual practice is to set the first landing with the bottom of the cage about 6 inches above the buffer springs. This means that merely providing a toothless portion at the point at which the drive pinion should become disengaged will cause the safety pinion to disengage from the rack and thus be unable to sense an abnormal descent (at probably the most critical point of the descent, near the first landing). Therefore, it is necessary to provide a system that keeps the safety pinion in mesh during normal operation yet allows the drive pinion to disengage, but only when the cage is being forced down into the buffer mechanism. Stated another way, any device which solves the problem must never disengage the drive pinion except when the cage is supported on the buffer, and such device must be able to distinguish between the drive pinion and the safety pinion before allowing such disengagement to occur.

Thus, in a broader aspect of the present invention, a drive pinion disengaging device for rack and pinion hoists is provided having an outer section of rack with toothed portions above and (preferably) below an at least potentially toothless portion, and a bridging rack section adapted to be removed at said toothless portion by said drive pinion when under a predetermined load to permit the latter to disengage the rack in case of malfunction. This permits the large rotational inertia to be dissipated without injury to the drive mechanism. The point of disengagement is such as to occur preferably only when the hoist is engaged by the safety landing buffers.

The bridging section is alternatively characterized in this specification and claims as the disengagable portion of the rack.

The bridging rack section may be in the form of a sliding rack mounted in a longitudinal slot in the main rack extending along the entire toothless portion and slightly up into the toothed portion above and normally secured in place by a shear pin, detent, or the like so as to bridge the toothless portion. Alternatively, the bridging section may be a rack having shearable teeth (preferably thinner than the main rack or optionally of a softer material).

In the latter embodiment of the present invention, a section of a toothed rack may be modified by removing the teeth therefrom except for a narrow strip extending longitudinally along the modified rack section. In a preferred embodiment thereof, all of the teeth are removed from the modified rack section leaving a toothless surface. A recess is cut into a side of the rack which is normal to the toothless surface. Bolted in this recess horizontally adjacent to the toothless surface is a narrow rack strip having teeth with dimensions and pitch equal to that of the unmodified toothed rack. In the event of an uncontrolled descent, the cage will be forced into the buffer springs and the drive pinion will travel down the rack onto the modified portion thereof, engaging only the narrow toothed strip. The load transmitted to the narrow toothed portion and generated by the maximum permissible torque of the gear box will cause the teeth of the narrow portion to be sheared by the drive pinion, permitting the drive pinion to spin freely, thereby expending its energy without contributing to the downward motion of the cage. In normal operation, the teeth of the narrow portion will not be sheared, because they are traversed only by the undriven safety pinion which precedes the drive pinion in downward travel (which safety pinion does not generate any significant torque). Thus, the safety pinion will always remain in mesh with the rack.

In accordance with another previously-mentioned aspect of the present invention, a section of a toothed rack is modified by removing the teeth from a portion thereof, thus forming a toothless surface disposed below a toothed surface. A slot or recess is cut centrally in the rack and extends longitudinally over a portion of the toothed and toothless surface. Within this slot is closely fitted a toothed inner section having a length which is less than that of the slot and which is longitudinally slidable therein. In a preferred embodiment, the slot and the inner section have a cross-sectional T-shape. The inner section is fastened to the modified rack section by shear pins, spring loaded detent means, or other fastening means capable of becoming unfastened under a predetermined loading (and preferably automatically resettable in the absence of such loading). Shear pins while not automatically resettable, are desireable because of their simplicity and low cost. Such inner section is positioned within the slot so that a portion of the slot vertically above the inner section remains empty. If the cage is forced into the buffer springs in an abnormal descent, the drive pinion will ride over the toothless surface of the modified rack section and engage only the inner section. The torque developed by the gear box will be transmitted to the inner rack section and snap the shear pin. This will cause the inner rack section to slide upward within the slot away from the drive pinion, allowing the same to rotate freely. In normal operation, the safety pinion, being disposed below the drive pinion, will engage the inner section over the toothless portion of the modified rack section, but will not snap the shear pin, having not developed any significant torque to do so; thus the inner rack section remains in its operative position under normal conditions.

In this specification and in the accompanying drawings, we have shown and described preferred embodiments of our invention and have suggested various alternatives and modifications thereof; but it is to be understood that these are not intended to be exhaustive and that many other changes and modifications can be made within the scope of the invention. The suggestions herein are selected and included for purposes of illustration in order that others skilled in the art will more fully understand the invention and the principles thereof and will thus be enabled to modify it in a variety of forms, each as may be best suited to the conditions of a particular use.

FIGS. 3 and 4 are side and front views respectively of a first preferred embodiment of the drive pinion disengaging device;

FIG. 5 is a cross-sectional view taken along line 5—5 of FIG. 4 of the first preferred embodiment;

FIGS. 7 and 8 are side and front views respectively of the modified rack section according to the second preferred embodiment;

FIG. 9 is a cross-sectional view taken along line 9—9 of FIG. 7;

FIG. 10 is a side view of the slidable inner section of the second preferred embodiment;

FIG. 11 is a cross-sectional view taken along line 11—11 of FIG. 10 of the slidable inner section;

Figure 14:
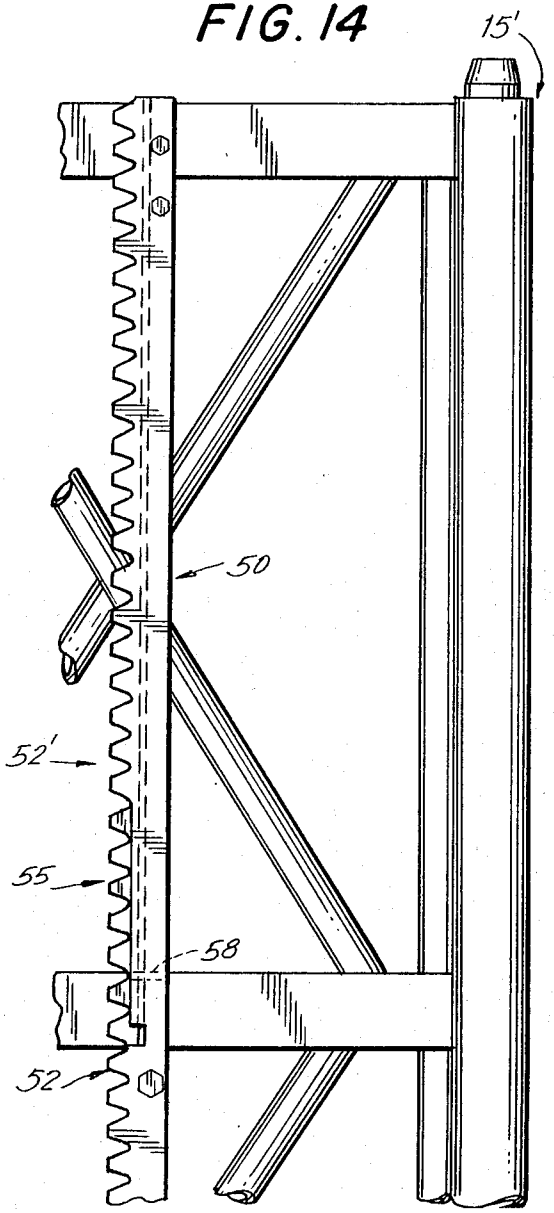
Figure 13:
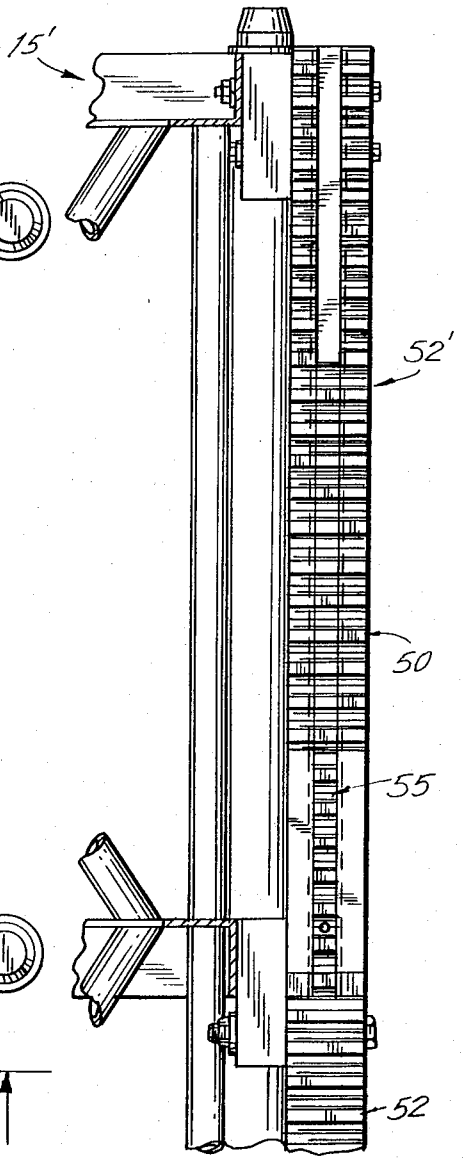
Figure 12:
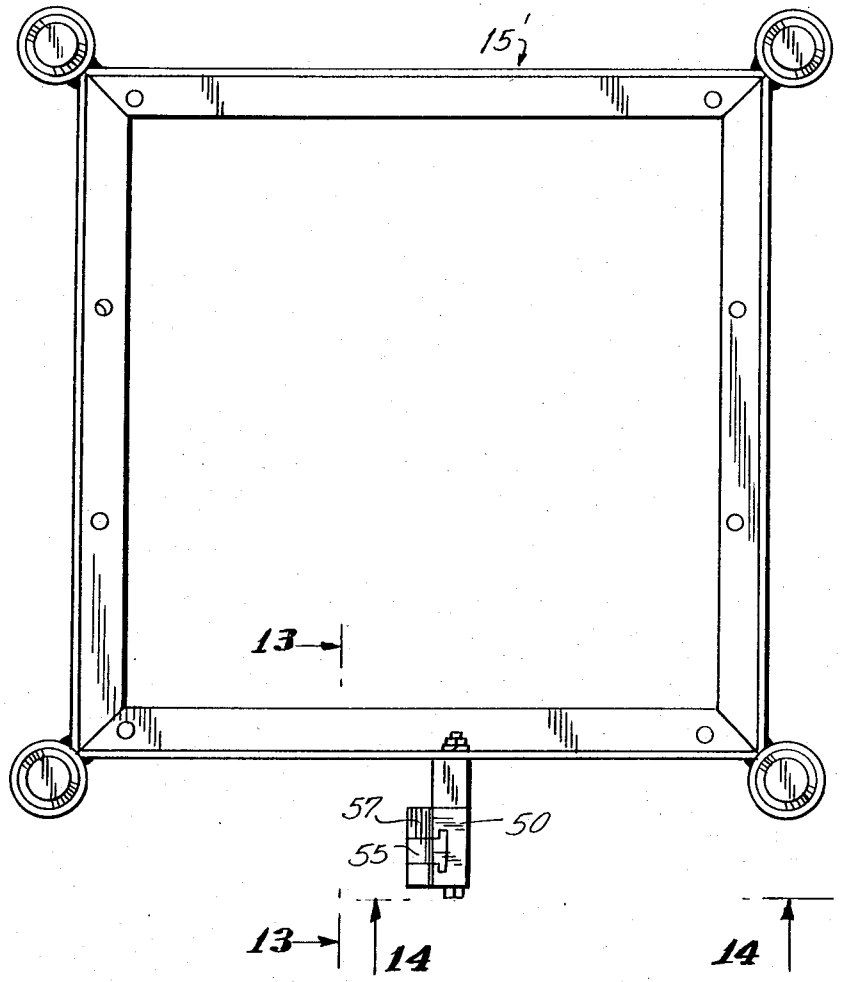
FIG. 12 is a plan view of a tower section showing a toothed rack affixed thereto which has been modified in accordance with the second preferred embodiment of the present invention.

FIGS. 13 and 14 are cross-sectional views taken along lines 13—13 and 14—14 respectively of FIG. 12 of the second preferred embodiment of the disengaging device; and

FIG. 15 is a diagrammatic sectional side view of a detent device useful in the second embodiment shown (in FIGS. 6 to 14) in lieu of a shear pin.

Figure 1:
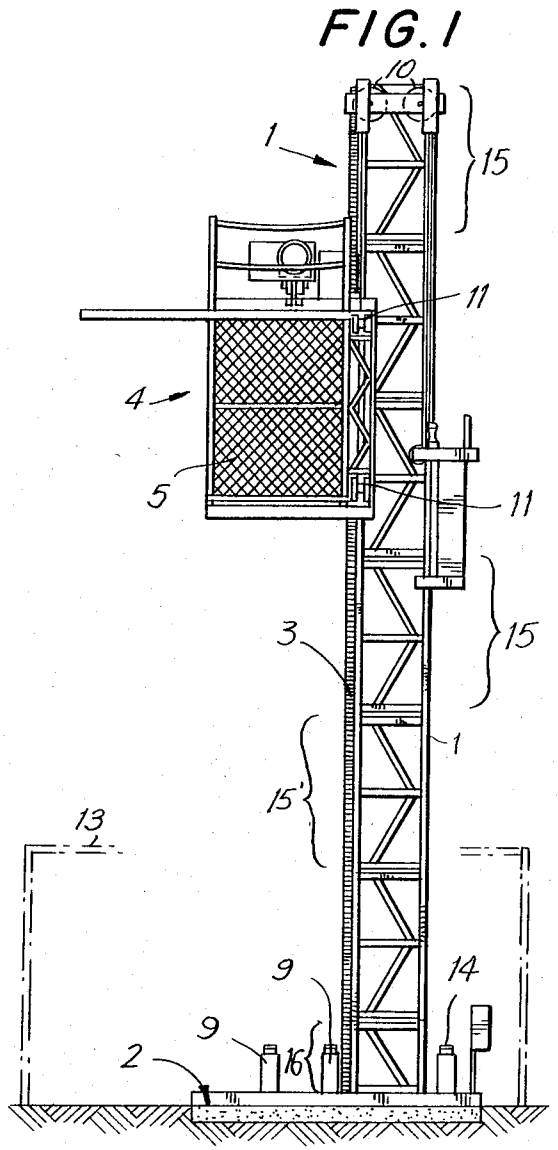
FIGS. 1 and 2 are side and front views respectively of a rack and pinion hoist, showing a special short tower section adapted to aid in the correct positioning of a modified rack section (carried on a separate standard-length tower, which latter incorporates a disengaging device according to the present invention)
Figure 2:
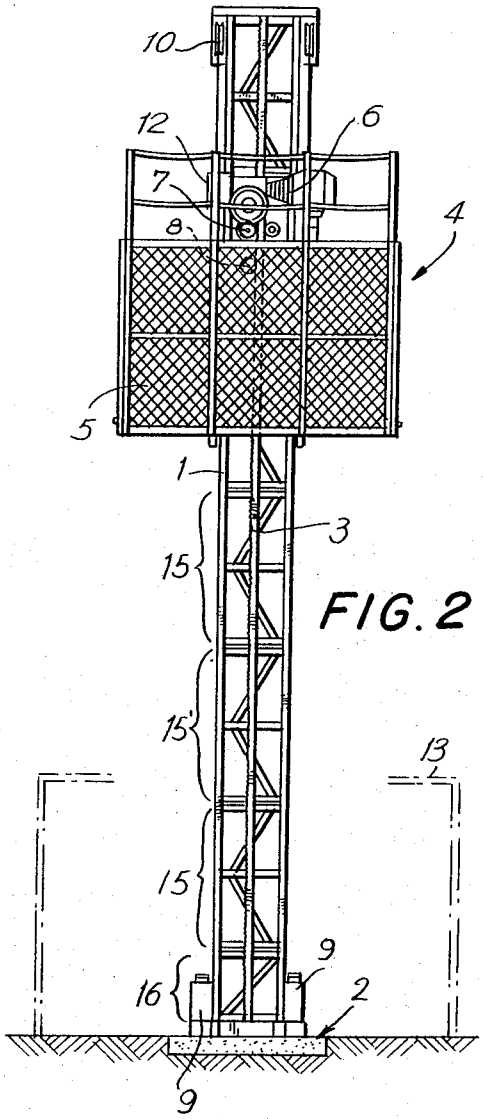

Referring now to the drawings in detail and initially to FIGS. 1 and 2, it will be seen that a rack and pinion hoist comprises basically a vertical tower 1 supported on a base 2 by guy wires (not shown) and having a toothed rack 3 affixed to a side thereof. On the rack travels an elevator portion 4 including a platform (not shown) or a cage 5. A drive mechanism 6 including a motor and gear reducer or gear box is normally affixed to the roof of the cage but may be attached elsewhere without affecting the operation of the invention as described herein. Rotatably driven by the drive mechanism is a drive pinion 7 which engages the toothed rack 3 and propels the elevator portion therealong. Disposed below the drive pinion 7 at a nominal distance of 14 inches is a safety of governor pinion 8. This is used to trip an emergency brake to stop the cage in the event of an uncontrolled descent. Attached to the base 2 and positioned below the cage 5 normally are buffer springs, but instead in the preferred embodiment hydraulic buffer devices 9 are used. As previously mentioned, buffer springs or the like are required by regulatory law and are used to reduce the impact force on the cage to 1g in an uncontrolled descent. The hydraulic buffers 9 have a nominal extended height of 36 inches and an 8 inch compression stroke. When used with the present invention, these hydraulic buffers 9 can meet the ANSI requirements. The use of a 36 inch height allows a buffer zone of 6 inches between the top of the buffers and the first landing and allows the first landing to be set at an optimal height of 42 inches, which is equivalent to the height of a truck bed above ground. Shown in FIGS. 1 and 2 is the typical counter-weighted hoist, though the invention will work just as well with un uncounterweighted hoist. Also shown in the drawings are a cathead 10, guide rollers 11, a braking mechanism 12, a ground enclosure 13 and counterweight buffer springs 14. The preferred tower is constructed mainly from standard 6 foot tubular sections 15 cross-braced for added support. When using an elevator section having a height of 10 feet, 9 inches (10'9") measured from the cage's bottom to the center of the drive pinion, it is preferable to interpose a 2 foot, 4 inch (2'4") tower section 16 between the base 2 and the first standard 6 foot tower section 15. This short tower facilitates the positioning of a 6 foot tower section 15', which is modified to include the disengaging device, so that the latter is in position to engage the drive pinion on the rack 3, at least when the cage 4 first contacts the top of the extended hydraulic buffers 9. In ascending order, the tower sections which comprise the tower would preferably be the short 2 foot, 4 inch (2'4") section 16, a standard 6 foot section 15, a 6 foot section 15' which is standard except for having a rack modified to include the disengaging device, and further standard 6 foot tower sections 15 superposed thereon to the desired height of the tower.

One of the preferred embodiments of the present invention, which can be referred to as the narrow rack strip, is shown in assembled form in FIGS. 3–5. A standard toothed rack section 3 affixed to a standard 6 foot tower section by bolts 30 is modified by removing the teeth from a portion thereof, forming a toothless surface 31 preferably 24 inches in length. A portion of a side of the rack which is normal to the toothless surface and proximate thereto is cut away to form a recess 32 having an approximate depth of ½ inch and a length of 24 inches. Fitted into this recess and fastened to the rack by bolts 33 is a narrow toothed strip 34, approximately ¼ inch in width. The strip 34 may either be constructed from the same metal as the rack or, if preferred, a softer metal. The teeth 35 of the narrow strip have the same dimensions and pitch as the teeth 36 of the standard rack section. When fitting the narrow strip into the recess 32 formed in the side of the rack, it is important to position it properly with respect to the rack section so that the teeth of the rack are aligned with that of the narrow strip; in this way a uniform continuous toothed surface is provided for the safety and drive pinions to engage and no discontinuity is present when the pinions transfer from the rack section to the narrow strip. It is important to reiterate that the safety pinion, which is located below the drive pinion, must remain in mesh during normal operation to prevent gear jamming and wear; this is why a standard rack 3 is required below the lowest normal operating point to which the drive pinion travels (i.e., below strip 34).

Operation of the narrow rack strip embodiment is as follows

In normal operation, when the cage descends to the lowest landing, the drive pinion is approximately 6 inches above the top of the narrow rack strip 34 and engages the unmodified portion of the rack 3 having teeth extending across a full face. The safety pinion, being disposed 14 inches below the drive pinion, has travelled onto the narrow rack strip 34 and remains in mesh therewith. But being undriven, the safety pinion does not develop sufficient torque to shear the teeth of the narrow strip. During an uncontrolled descent, as the cage overshoots the first landing and is driven into the hydraulic buffers 9, the drive pinion 7 leaves the main section of rack 3 and passes onto the narrow rack section 34, engaging the teeth 35 thereof. Because the drive pinion 7 has developed a relatively large torque by being driven by the drive mechanism 6, the load transmitted by the drive pinion 7 to the teeth 35 of the narrow strip 34 is such that the teeth 34 are sheared thereby allowing the drive pinion to rotate freely, expending its energy in a "no load" condition. The standard drive pinion 7 is made of much harder steel than the rack 3 or the strip 34. As a result the drive mechanism, and in particular the motor and the reducing gears, are spared any damage. The narrow strip 34 is readily accessible and being relatively inexpensive may be easily replaced without dismantling the tower.

A second drive pinion disengaging device is shown in FIGS. 6–14 in its preferred form and can be referred to for purposes of convenience as the sliding rack embodiment. A standard 6 foot, toothed outer rack section 50 is modified, as shown in the side view of FIG. 7 and the front view of FIG. 8, by removing the teeth over a 10 inch portion thereof to provide a toothless surface 51 disposed above the normal toothed face 52 and below toothed section 52'. Cut centrally in the toothed face of the rack 50 and extending longitudinally over the toothed 52' and toothless 51 portions of the rack is a slot 53, shown cross-sectionally in FIG. 9 to be T-shaped. The slot 53 may, but does not necessarily have to, extend from the lower end of the toothless portion 51 to the upper end of the 6 foot toothed outer rack section 50, as shown in FIG. 8. A slot 53 extending from the lower end of the toothless portion 51 and having a length which is preferably at least twice that of the toothless portion 51 will be sufficient for the disengaging device to operate; this will become apparent in the description that follows. A notch 54 may be provided in the lower end of the toothless portion 51 to facilitate machining of the slot 53.

Within the slot 53 is closely fitted an inner section 55, as shown in FIG. 10, having a cross-sectional T-shape, as shown in FIG. 11, conforming to the shape of the slot 53. Being T-shaped, the inner section 55 is retained within the slot 53 formed in the outer rack section 50 and yet is slidable longitudinally therein. Other methods known in the art (such as dove tailing, etc.) may be used to retain an inner section different in shape from that described within a conforming recess without affecting the operation of the disengaging device. The inner section has teeth 56 which have dimensions and a pitch equal to that of the teeth 57 of the outer rack section 50. The inner and outer rack sections 55 and 50 are assembled as shown in FIGS. 12–14. Fastening means such as a shear pin 58, a spring-loaded detent 58', etc., may be inserted in pre-formed holes 59, 59' to fasten the inner section 55 to the outer section 50 in an at-rest position. The at-rest position of the inner section 55 relative to the outer section 50 is chosen so that the inner section 55 extends across the toothless surface 51 and overlaps a substantial portion of toothed section 52' of the outer rack section, and so that the teeth 56 of the inner section are in alignment with the teeth 57 of the outer section to provide a continuous toothed surface over which the safety and drive pinions may travel. Alignment of the teeth of the outer section 50 with those of the inner section 55 may be facilitated if the inner section is of sufficient length to allow at least one tooth 56 thereof to be horizontally adjacent to a tooth 57 of the outer rack section. The material from which the shear pin 58 is constructed, and the diameter of the shear pin, are chosen so that the shear pin breaks when a predetermined load is exerted upon the sliding inner rack section 55 by the drive pinion 7. The alternative detent 58' (a typical structure being shown in FIG. 15) may similarly be designed to permit relative movement of sections 50 and 53 only under said predetermined loading. The detent 58' has the advantage of being reuseable. In contrast, a shear pin 58 requires replacement. The body of detent 58' may be securely fit in hole 59 with its moveable nose 60 biased to extend into hole 59' by action of its internal spring 61. Advantageously, the bottom of inner section 55 can have a tapered central slot 62 (see FIG. 10) to aid in the repositioning of biased nose 60 into hole 59' as section 55 is slid downwardly across the toothless portion 51 of section 50.

Figure 6:
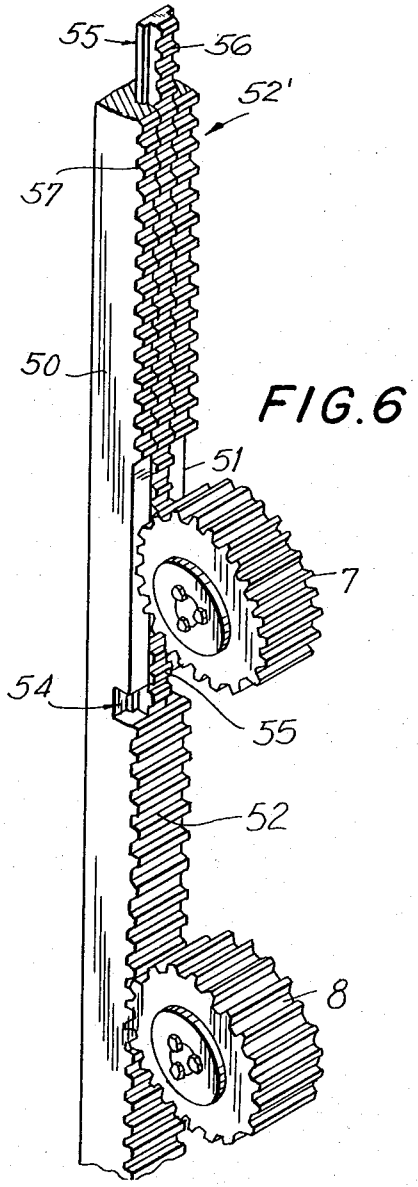
FIG. 6 is a perspective view of the drive and safety pinions on a modified section of rack having a slidable inner section, thus depicting a second preferred embodiment of the drive pinion disengaging device.

A perspective view of the sliding rack embodiment showing the drive and safety pinions engaging the rack is shown in FIG. 6 which should be referred to in the following description of operation.

In normal operation and as stated for the narrow rack strip embodiment, when the cage descends to the first landing, the drive pinion 7 is above the top of the slidable inner section 55 fixed in its rest position. The drive pinion 7 will engage the teeth of the outer section 52' on opposite sides of the recess. The safety pinion 8 will travel over the toothless portion 51 of the outer rack section 50 and engage the inner slidable section 55. The safety pinion does not develop the torque necessary to snap the shear pin 58 holding the inner section in its at-rest position. Thus, the inner section 55 does not slide upward within the recess during normal operation of the hoist. The inner slide rack 55 provides, in combination with the toothed portion 57 of the outer section 50, a continuous toothed face which keeps the safety pinion 8 in mesh over the full distance that the cage travels. In the event of an uncontrolled descent, the drive pinion 7 travels beyond the toothed portion 57 of the outer rack section 52' onto solely the slidable inner section 55. Having sufficient torque, the drive pinion 7 transmits its load to the sliding inner rack section 55, snapping the shear pin 58 and forcing the inner rack 55 to slide upwardly within the slot 53 away from the drive pinion 7, leaving the same to spin freely and unloaded over the toothless surface 51 and disengaged from any portion of the rack 3.

What is claimed is:

1. A drive overload safety device for personnel hoists incorporating a rack and a drive pinion of the type further carrying a safety pinion for continuous engagement with said rack below said drive pinion, comprising disengaging means for disengaging said drive pinion from said rack approximately at a predetermined height of said hoist in response to a predetermined excess drive load on said drive pinion thereat, said means comprising a disengagable portion of said rack having teeth drivingly disengagable by being displaced relative to the remaining portion of said rack by said drive pinion when the latter is subjected to said predetermined excess drive load and is positioned on said rack at said approximate predetermined height, and at least that part of the rack adjacently above the disengagable portion having teeth more resistant to being displaced by said drive pinion so as to safely support said personnel hoist particularly when subject to precipitous descent.

2. A device according to claim 1, wherein said disengaging means is a rack having teeth which are sound under normal use, but shear when subjected to said predetermined excess drive load.

3. A device according to claim 2, wherein said disengaging means is a thin rack portion having only a small fraction of the width of the main rack.

4. A device according to claim 1, wherein said disengagable portion has a toothless rack portion and an adjacent main rack portion immediately thereabove which together have a longitudinal retaining slot therein, and said disengagable portion further has an inner rack section slidably captured in and shorter than said slot and further being at least slightly longer than said toothless rack portion, and further comprises fastening means for holding said inner rack section in position to bridge said toothless portion and for permitting said inner rack section to slide up away from said toothless portion by action of said drive pinion when the latter is subjected to said predetermined excess drive load.

5. A device according to claim 4, wherein said fastening means comprises a shear pin.

6. A device according to claim 4, wherein said fastening means comprises a detent.

7. In combination with a rack and pinion hoist of the type in which a cage is elevated by and supported on a vertical tower by a drive pinion which engages a toothed rack affixed to the tower, said drive pinion being rotatably driven by a drive means affixed to said cage, in which means for buffering the descent of said cage is positioned below said cage and in which an undriven safety pinion is disposed below said drive pinion and engages said toothed rack, the improvement which comprises means for disengaging said drive pinion from said rack when said cage descends to within a predetermined distance from said cage buffer means, said disengaging means including an outer section of said rack having a toothed portion and a toothless portion disposed therebelow and a slot formed in the rack face thereof and extending longitudinally through said toothless portion and at least part of said toothed portion immediately thereabove, an inner section of rack having teeth of equal dimension and pitch to that of said outer section, said inner section and said slot of said outer rack section being mutually shaped such that said inner section is captured by and longitudinally slidable within said slot, said inner section being positioned in a first position within said slot to bridge said toothless portion of said outer section with the overlapping teeth of said inner section in alignment with the teeth of said outer section, said inner section being adapted to slide upwardly within the slot from said first position to a second position when said drive pinion under a predetermined torque load engages said inner section at said toothless portion of said outer section thereby allowing said drive pinion to rotate freely.

8. In combination with a rack and pinion hoist of the type in which a cage is elevated on a vertical tower by a drive pinion which engages a toothed rack affixed to the tower, said drive pinion being rotatably driven by a drive means affixed to said cage, in which means for buffering the descent of said cage is positioned below said cage and in which an undriven safety pinion is disposed below said drive pinion and engages said toothed rack, the improvement which comprises means for disengaging said drive pinion from said rack when said cage precipitously descends approximately to a predetermined height and engages said cage buffer means, said disengaging means comprising a disengagable portion of said rack having teeth drivingly disengagable by being displaced relative to the remaining portion of said rack by said drive pinion when said drive pinion is approximately at said predetermined height and is subjected to a predetermined excess drive load.

9. A device according to claim 8 or 7, wherein said buffer means comprises at least a pair of short stroke progressively resistive hydraulic buffers positioned at the bottom of said tower.

10. A rack and pinion hoist according to claim 7 wherein said slot has a T-shape sectionally and said inner section has a T-shape sectionally.

11. A rack and pinion hoist according to claim 7, which further comprises fastening means for joining said inner section to said outer section in said first position, said fastening means being adapted to shear off when said drive pinion engages said inner section under said torque load.

12. A rack and pinion hoist as recited in claim 7, wherein at least one of the teeth of said inner section is horizontally aligned with one of the teeth of said outer section.

13. A rack and pinion hoist as recited in claim 7 wherein a toothed section of said rack is disposed below said toothless portion of said disengaging means, the teeth of said inner section of said disengaging means being in alignment with the teeth of said toothed rack section disposed below said toothless portion when said disengaging means is in said first position.

14. A hoist according to claim 8, wherein said disengaging means further comprises a section of said rack having teeth extending across a relatively narrow horizontal portion of said rack thus forming a toothless surface adjacent to said narrow toothed portion, said teeth of said narrow toothed portion being adapted to be sheared by said drive pinion when said drive pinion under a predetermined torque load engages said narrow portion thereby allowing said drive pinion to rotate freely.

15. A rack and pinion hoist as recited in claim 14 wherein said narrow toothed portion of said rack section is a separate removeable section fitted into a recess formed in a side of said rack, said side being normal to said toothless surface, the teeth of said narrow portion being positioned relative to the teeth of said rack section to provide a continuous toothed surface for said safety pinion as said safety pinion travels from said toothed rack to said narrow portion.

16. A rack and pinion hoist as recited in claim 9 wherein a toothed section of said rack is disposed below said narrow toothed portion of said disengaging means.

17. A hoist according to claim 8, wherein said disengaging means further comprises an outer section of said rack having a toothed portion and a toothless portion disposed therebelow and a slot formed in the rack face thereof and extending longitudinally through said toothless portion and at least part of said toothed portion immediately, thereabove, an inner section of rack having teeth of equal dimension and pitch to that of said outer section, said inner section and said slot of said outer rack section being mutually shaped such that said inner section is captured by and longitudinally slidable within said slot, said inner section being positioned in a first position within said slot to bridge said toothless portion of said outer section with the overlapping teeth of said inner section in alignment with the teeth of said outer section, said inner section being adapted to slide upwardly within the slot from said first position to a second position when said drive pinion under a predetermined torque load engages said inner section at said toothless portion of said outer section thereby-allowing said drive pinion to rotate freely.

18. In combination with a rack and pinion hoist of the type in which a cage is elevated on a vertical tower by a drive pinion which engages a toothed rack affixed to the tower, said drive pinion being rotatably driven by a drive means affixed to said cage, in which means for buffering the descent of said cage is positioned below said cage and in which an undriven safety pinion is disposed below said drive pinion and engages said toothed rack, the improvement which comprises means for disengaging said drive pinion from said rack when said cage descends to within a predetermined distance from said cage buffer means, said disengaging means including a section of said rack having teeth extending across a relatively narrow horizontal portion of said rack thus forming a toothless surface adjacent to said narrow toothed portion, said teeth of said narrow toothed portion adapted to be sheared by said drive pinion when said drive pinion under a predetermined torque load engages said narrow portion thereby allowing said drive pinion to rotate freely.

19. A rack and pinion hoist as recited in claim 18 wherein said narrow toothed portion of said rack section is a separate removeable section fitted into a recess formed in a side of said rack, said side being normal to said toothless surface, the teeth of said narrow portion being positioned relative to the teeth of said rack section to provide a continuous toothed surface for said safety pinion as said safety pinion travels from said toothed rack to said narrow portion.

* * * * *